US007766503B2

(12) United States Patent
Heiking et al.

(10) Patent No.: US 7,766,503 B2
(45) Date of Patent: Aug. 3, 2010

(54) MEDICAL-PATIENT-ROOM CEILING LIGHT FIXTURE

(75) Inventors: Nathan D. Heiking, Kenosha, WI (US); James W. Hawkins, Lake Bluff, IL (US)

(73) Assignee: Kenall Manufacturing Co., Gurnee, IL (US)

( * ) Notice: Subject to any disclaimer, the term of this patent is extended or adjusted under 35 U.S.C. 154(b) by 307 days.

(21) Appl. No.: 12/023,807

(22) Filed: Jan. 31, 2008

(65) Prior Publication Data

US 2009/0196023 A1 Aug. 6, 2009

(51) Int. Cl.
*F21S 8/04* (2006.01)
*F21V 17/00* (2006.01)

(52) U.S. Cl. ..... 362/147; 362/224; 362/375; 362/804

(58) Field of Classification Search ..... 362/33, 362/224, 225, 367, 375, 804, 260, 572, 147
See application file for complete search history.

(56) References Cited

U.S. PATENT DOCUMENTS 4,528,764 A * 7/1985 Cobb ..... 40/553
5,038,254 A * 8/1991 Fabbri et al. ..... 362/33
5,128,850 A 7/1992 Juodvalkis
5,172,976 A * 12/1992 Bogdanovs ..... 362/374
5,676,633 A 10/1997 August
5,997,158 A 12/1999 Fischer et al.
6,443,591 B1 * 9/2002 Swensson et al. ..... 362/147
6,863,417 B2 * 3/2005 Hill, Wolfram ..... 362/233
6,870,673 B2 3/2005 Cromer et al.
6,888,322 B2 5/2005 Dowling et al.
7,177,079 B2 * 2/2007 Cromer et al. ..... 359/460
7,567,833 B2 * 7/2009 Moctezuma De La Barrera et al. ..... 600/424
2002/0021266 A1 2/2002 Koyama et al.
2003/0063078 A1 4/2003 Hanari et al.
2003/0155866 A1 8/2003 Iwata et al.
2004/0212606 A1 10/2004 Miyachi et al.
2005/0212731 A1 9/2005 Kawashima
2007/0018563 A1 1/2007 Okai et al.
2009/0034247 A1 * 2/2009 Boyer ..... 362/225

OTHER PUBLICATIONS

Color Kinetics PDS-60CA 7.5V Specification Datasheet (2003), http://colorkinetics.com/support/datasheets/PDS60ca7_5v.pdf.
Color Kinetics iCOLOR MODULE FX Specification Datasheet (2003), http://colorkinetics.com/support/datasheets/iColorModuleFX.pdf.

(Continued)

*Primary Examiner*—Stephen F. Husar
*Assistant Examiner*—Peggy A. Neils
(74) *Attorney, Agent, or Firm*—Jansson Shupe & Munger Ltd.

(57) ABSTRACT

A ceiling light fixture for medical patient rooms and a method for the same. The fixture comprises a body which defines a middle region and two side regions along opposite sides of the middle region. A cover is movably attached to the body and includes a lens over at least the middle region. A graphics image is associated with the middle region and is substantially parallel to the lens. At least one graphics-light source is within the middle region and configured for illuminated display of the graphics image. At least one exam-light source is located within each of the two side regions.

25 Claims, 11 Drawing Sheets

OTHER PUBLICATIONS

The Sky Factory, Ceiling Products (2007), http://www.theskyfactory.com/products.htm.
The Sky Facotry, Contact Us (2007), http://www.theskyfactory.com/contact.php.
SignsByWeb Products (2004), http://www.cotteradvertising.com/products.html.
SignsByWeb Indoor Lighted Signs and Light Box Signs (2004), http://www.cotteradvertising.com/indoor-lighted-signs.html.
SignsByWeb Indoor Use Steel Light Box Signs (2004), http://www.cotteradvertising.com/steel_light_box_signs.html.
Digital Pre-Press International Duratrans Printing (2007), http://www.dpi-sf.com/duratrans.htm.
Guangzhou You Guang New Material Ltd. Backlit Signages, undated, http://www.slim-signs.com/jishu_en.html.
Blue River Digital Inc., Light Boxes, undated, http://www.blueriverdigital.com/lightboxes.

* cited by examiner

LED SYSTEM SCHEMATIC

LED SYSTEM SCHEMATIC

MEDICAL-PATIENT-ROOM CEILING LIGHT FIXTURE

FIELD OF THE INVENTION

This invention is related generally to interior luminaires and more particularly to lighting fixtures which are ceiling-mounted and include at least one examination light and a graphics light box, most particularly luminaires used in medical-patient rooms.

BACKGROUND OF THE INVENTION

Many different types of lighting fixtures, including ceiling-mounted fixtures for various applications and locations, are known in the art. Such fixtures have been installed for illuminating stores, offices, supermarkets, schools, hospitals, banks, and other interior areas. Appreciating the versatility of such lighting fixtures, including the many engineering designs and configurations, there remains a need for a ceiling-mounted fluorescent or LED (light-emitting diode) luminaire for a medical-patient-room which provides a high-output medical examination light as well as a light which is psychologically pleasing to the patient room environment provided through a graphics light box. Traditional lighting fixtures are not readily adaptable for this purpose. In particular, conventional structures and lighting methods are not adapted for providing adequate examination light while also being psychologically pleasing to patents.

Many ceiling-mounted fluorescent and LED luminaires used in locations such as medical-patient-rooms require a fixture which is unique, high-performance and also a high-value lighting solution. The typical patient room will contain high-output examination lights for a doctor or nurse to conduct either routine or emergency procedures without the need to transport a patient to a different location. In recent years, the medical industry has given increased attention to the psychological well-being of the patient and the role it plays in patient recovery.

There is a need for a lighting fixture which incorporates both a medical examination light as well as a graphics light box which, when mounted above a patient bed, would provide pleasing images for the patient to observe. There is also a need for a light the cover of which can be attached, closed, removed and maintained by a single individual.

Various ceiling-mounted lighting fixtures have been developed to include an apparatus and a method for installing the fixture. An example of such a prior art fixture is disclosed in U.S. Pat. No. 5,997,158 (Fischer et al.). Color changing devices have also been developed. An example of such a prior art apparatus is seen in U.S. Pat. No. 6,888,322 (Dowling et al.). Methods and apparatus have also been devised to reduce patient stress and expedite recovery as seen in U.S. Pat. Nos. 6,870,673 (Cromer et al.) and 5,676,633 (August).

Some lighting fixtures in the prior art require that the medical examination light and the graphics light box be separate fixtures. This mandates that three or more separate lighting fixtures be purchased, installed and maintained per hospital bed. The increased cost and maintenance time translates into lost revenue for the hospital. Therefore, it would be desirable to have a lighting fixture which incorporates at least one examination light and a graphics light box into a single fixture housing.

When using a lighting fixture in a medical setting, it is particularly important that the fixture be sealed from the environment and be able to be cleaned. Medical-patient-room ceiling light fixtures are routinely used in patient examination rooms, and given the sterile atmosphere that accompanies these locations, the lighting fixtures need to be sealed and routinely sanitized. Therefore, it would be desirable to have a lighting fixture which is sealed from the environment and also easy to clean. Such fixtures must be strong enough to withstand numerous and frequent cleanings and also must allow easy access for cleaning. Furthermore, the fixture should be sealed so as not to allow microscopic particles to escape into the lighting fixture or the ceiling space of the facility. Thus, for these several reasons, it is desirable to have a lighting fixture which is completely sealed from the surrounding environment.

Some lighting fixtures of the prior art necessitate several people to work on a single fixture for installation or routine maintenance, such as lamp replacement. Specifically, if the door on a lighting fixture is large in size, installing, changing the door, or accessing the lamps requires two or three maintenance people to remove the door and handle it. This requires a substantial amount of labor and is time-consuming. It would be desirable to have a lighting fixture with a large door and which would necessitate only one person to attach, close, or remove the door and service the fixture.

In summary, there are a number of problems and shortcomings in prior lighting fixtures for such applications.

OBJECTS OF THE INVENTION

It is an object of this invention to provide a medical-patient-room ceiling light fixture that incorporates at least one medical examination light and a graphics light box into a single fixture housing while overcoming some of the problems and shortcomings associated with the prior art.

Another object is to provide a medical-patient-room ceiling light fixture which provides a psychologically pleasing patient room environment.

Another object is to provide a medical-patient-room ceiling light fixture which is a completely sealed structure so as not to allow microscopic particles to pass from the room and into the ceiling space of the hospital facility.

Another object is to provide a medical-patient-room ceiling light fixture with a large door which can be easily attached, closed and removed by a single individual.

Yet another object is to provide a medical-patient-room ceiling light fixture which is low-maintenance and which can be maintained by a single individual.

These and other objects of the invention will be apparent from the following descriptions and from the drawings.

SUMMARY OF THE INVENTION

This invention is a ceiling-mounted light fixture for medical patient rooms which has at least one exam-light and a graphics image. The lighting fixture comprises: a body which defines a middle region and two side regions along opposite sides of the middle region; a cover which is movably attached to the body and includes a lens over at least the middle region; a graphics image associated with the middle region and substantially parallel to the lens; at least one graphics-light source which is within the middle region and is configured for illuminated display of the graphics image; at least one exam-light source which is within each of the two side regions; and a fixture controller which separately controls the light sources. The graphics image is displayed for the patient along the middle region and illumination for medical examination is provided from the side regions.

In highly preferred embodiments, the cover is a single structure over the middle region and both of the side regions.

Preferably, the lens is sealingly engaged with the cover, and the cover is sealingly engaged with the body. It is preferred that the lens is a middle lens and the fixture further includes two side lenses each over a respective one of the side regions. It is highly preferred that the side lenses are sealingly engaged with the cover.

It is preferred that the lens has an inside surface and the graphics image is on a separate light-transmissive graphics layer removably placed on the inside surface. In the invention, it is highly desirable to further include a separate inner layer and the graphics layer is sandwiched between the lens and the inner layer. In such an embodiment, the inner layer is preferably a light-diffusing layer.

In some embodiments, the at least one graphics-light source is a plurality of fluorescent lamps. In another embodiment, the at least one graphics-light source is an array of white LEDs. Preferably, the fixture includes a semi-transparent screen layer wherein the at least one graphics-light source is an array of color-controllable LEDs and the graphics image is formed by LED illumination of the screen layer. In certain desirable embodiments, the lens and the screen layer are a single layer. Preferably, the fixture controller is programmed to temporally control the LEDs of the array and the programmed fixture controller is programmed to be controllable.

It is highly preferred that the body has a rectangular cover-engaging perimeter and includes a first flange along one perimeter edge having at least one hook-receiving opening therein and a second flange along the opposite perimeter edge having at least one suspension-member-receiving opening. In highly preferred embodiments, the cover includes a rectangular frame and at least one catch arm with a proximal end rotatably mounted to one edge of the frame and a distal end having a catch-arm hook, each hook being removably insertable in one of the hook-receiving opening(s). In these embodiments, at least one suspension member is mounted to an opposite edge of the frame, each suspension member is insertable in one of the suspension-member-receiving opening(s), the catch arm(s) and suspension member(s) each have sufficient length to suspend the cover away from the body along its entire cover-engaging perimeter when they are hangingly engaged with the flanges, and frame fasteners along the frame engage the perimeter in a fixture-closed position.

In some highly preferred embodiments, one-person servicing is facilitated by the cover being supported along one perimeter edge in a fully-open position, being supported along two opposite edges in a suspended position, and being fully engaged with the body in the fixture-closed position.

Also in highly preferred embodiments, each of the suspension member(s) is a spring clip. Preferably, there are a pair of catch arms spaced along the one edge of the frame and a pair of spring clips spaced along the opposite edge of the frame.

A preferred method for facilitating changing of graphics images on the ceilings of a plurality of patient rooms in a medical facility comprises the steps of: installing a plurality of ceiling light fixtures in the patient rooms; opening the covers of a plurality of the fixtures; removing the graphics images from each of the opened fixtures; replacing the removed graphics images with other graphics images; and closing the covers. It is highly preferred that the graphics image is displayed for the patient along the middle region and illumination for medical examination is provided from the side regions.

The removed graphics image is replaced with a different graphics image selected from a plurality of graphics images. Preferably, the step of removing the graphics images includes removing each of the graphics images from its corresponding cover. Also in preferred methods, the step of removing the graphics images includes fully detaching each of the opened covers from its corresponding fixture body.

The term "catch arm" as used herein refers to an arm the purpose of which is to catch and hold.

The term "light-diffusing layer" as used herein refers to a layer or lens which scatters light such that images are substantially blurred.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

Figure 1:
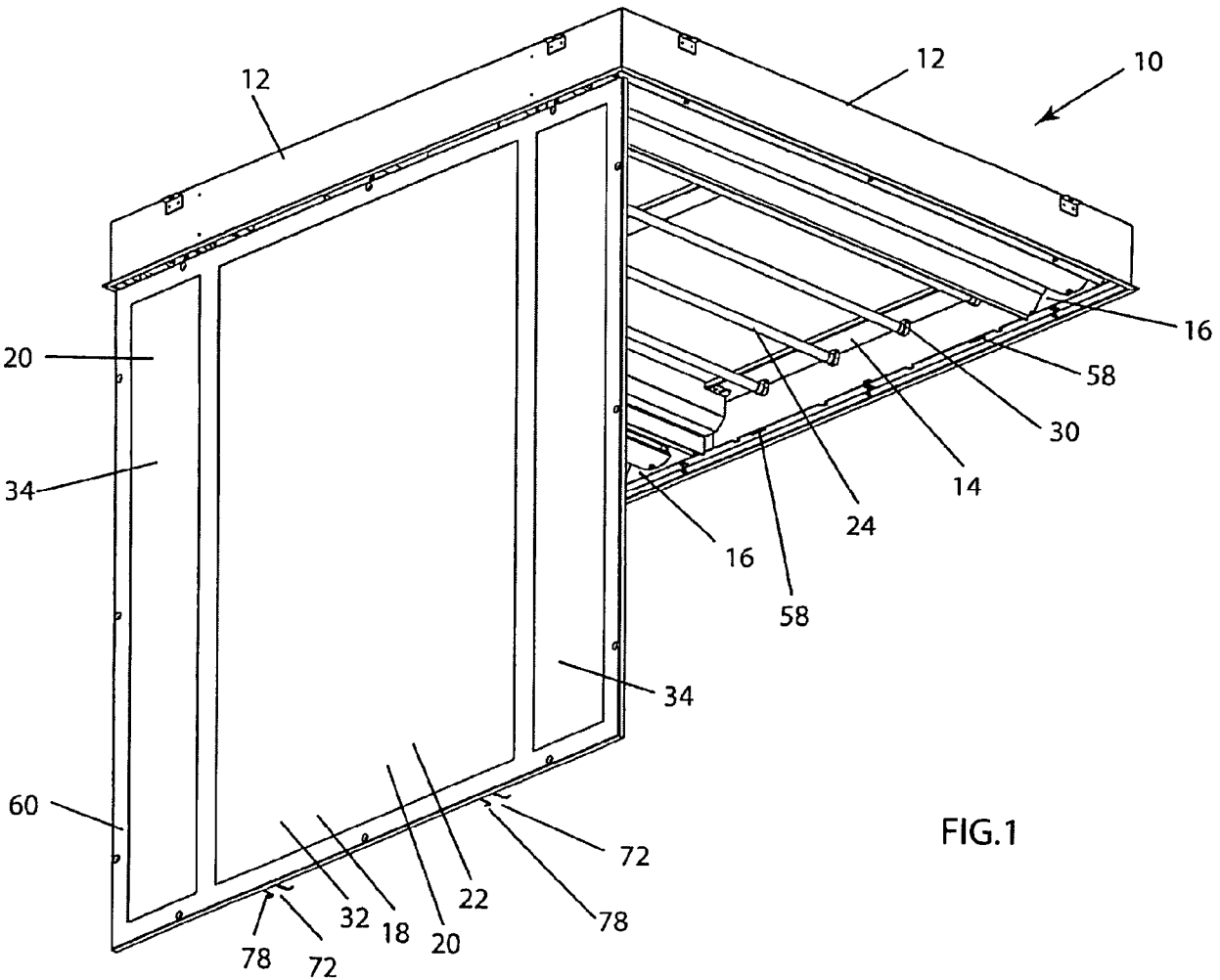
FIG. 1 is a perspective view of the lighting fixture with the cover in the open position.
Figure 2:
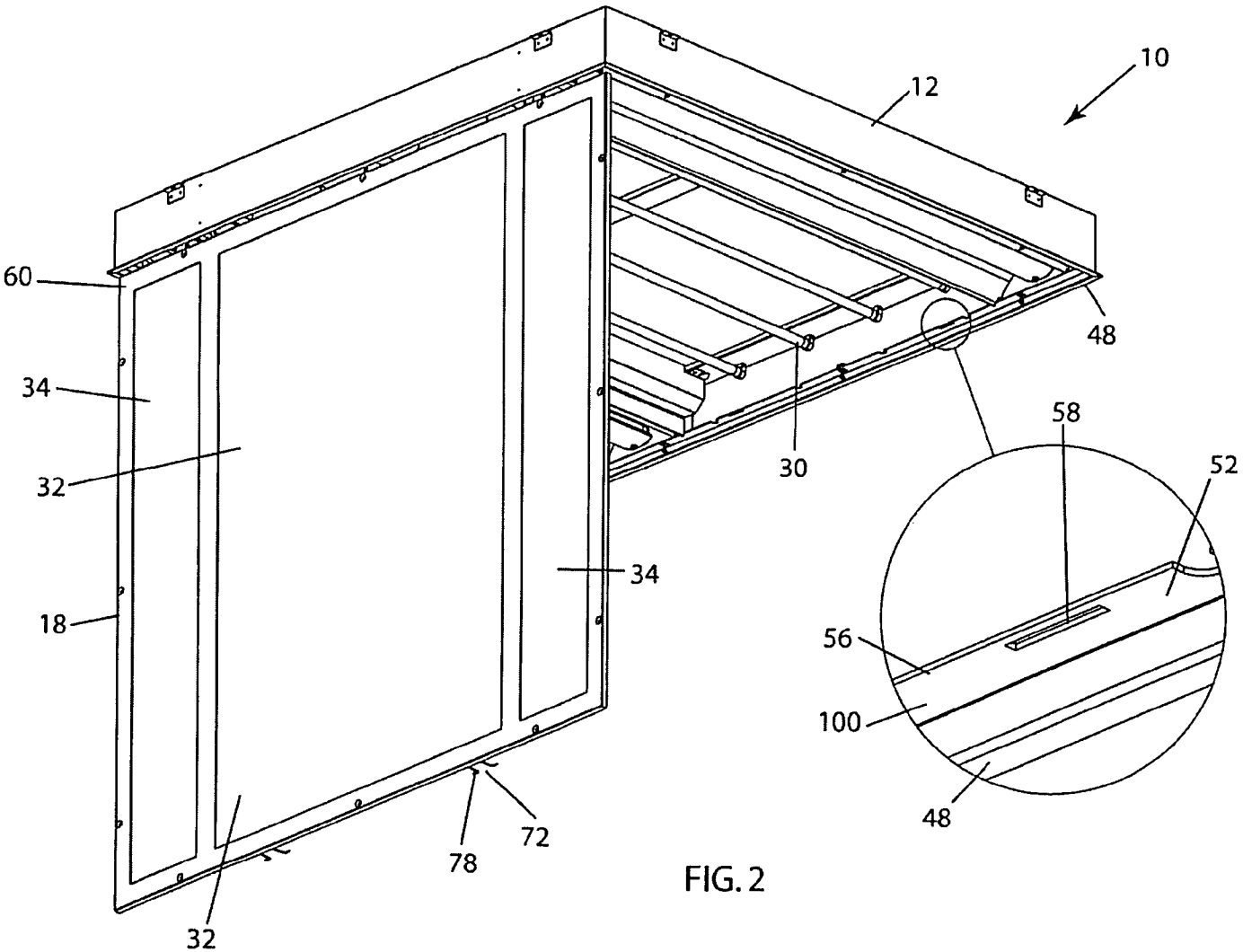
FIG. 2 is a perspective view of the lighting fixture of FIG. 1, with the cover in the open position and illustrating the suspension-member-receiving opening.
Figure 3:
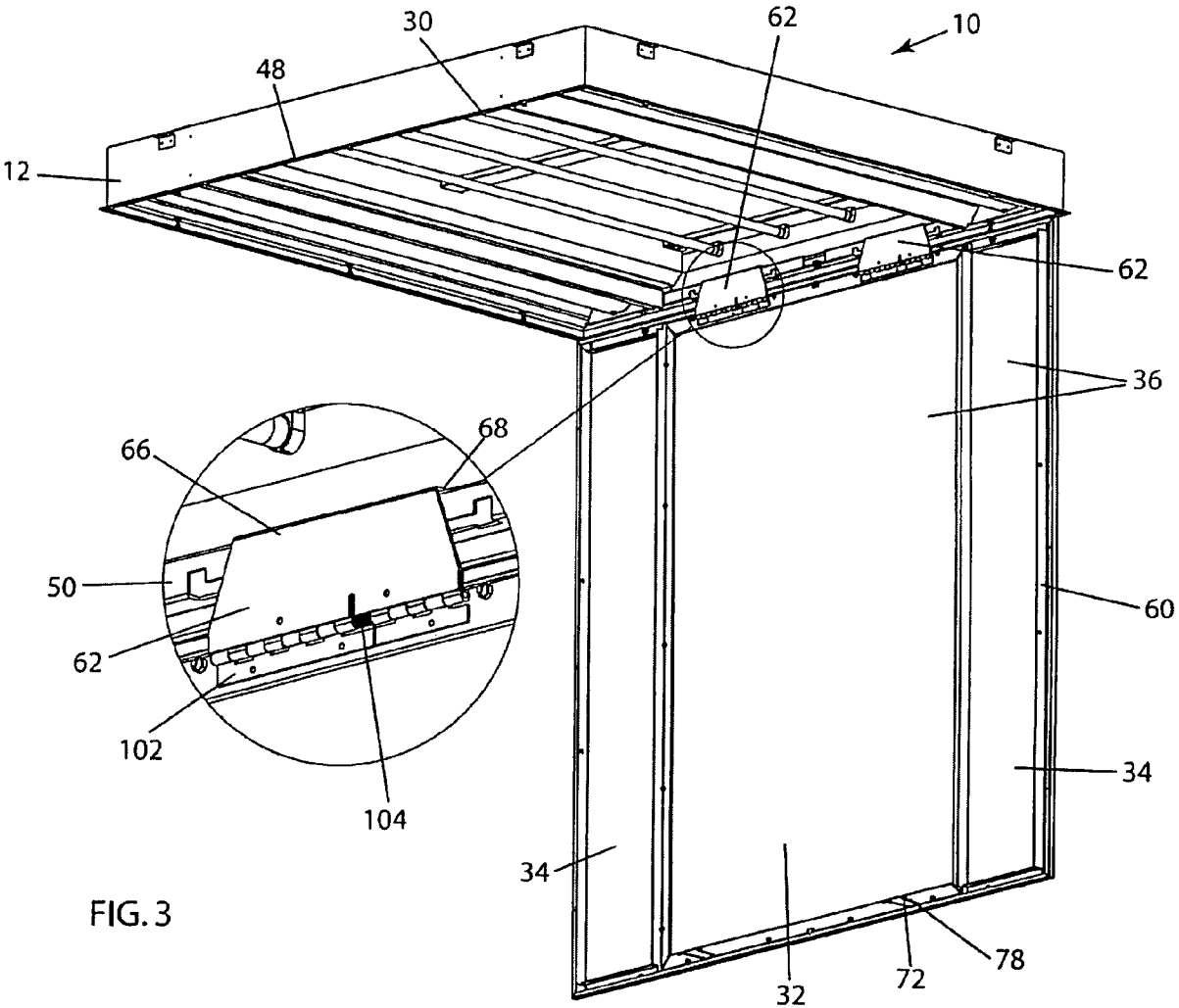
FIG. 3 is a perspective view of the lighting fixture of FIG. 1, with the cover in the open position and illustrating a catch arm.

FIGS. 1-5 illustrate lighting fixture 10 having at least one exam-light 26 and a graphics image (not illustrated). As shown in FIG. 1, lighting fixture 10 has body 12 which has middle region 14 and two side regions 16 along opposite sides of middle region 14. As illustrated in FIGS. 1-3, lighting fixture 10 also has cover 18 moveably attached to body 12 which includes lens 20 over at least middle region 14. Lighting fixture 10 also includes a graphics image which is associated with middle region 14 and which is substantially parallel to lens 20. At least one graphics-light source 24 is within middle region 14 and is configured for illuminated display of the graphics image as shown in FIGS. 1-3. FIGS. 1-3 also illustrate lens 20 upon which graphics image 22 is illuminated. FIGS. 1-3 do not illustrate a particular graphics image on lens 20, but it is readily understood that the graphics image is viewed on middle lens 32.

Figure 5:
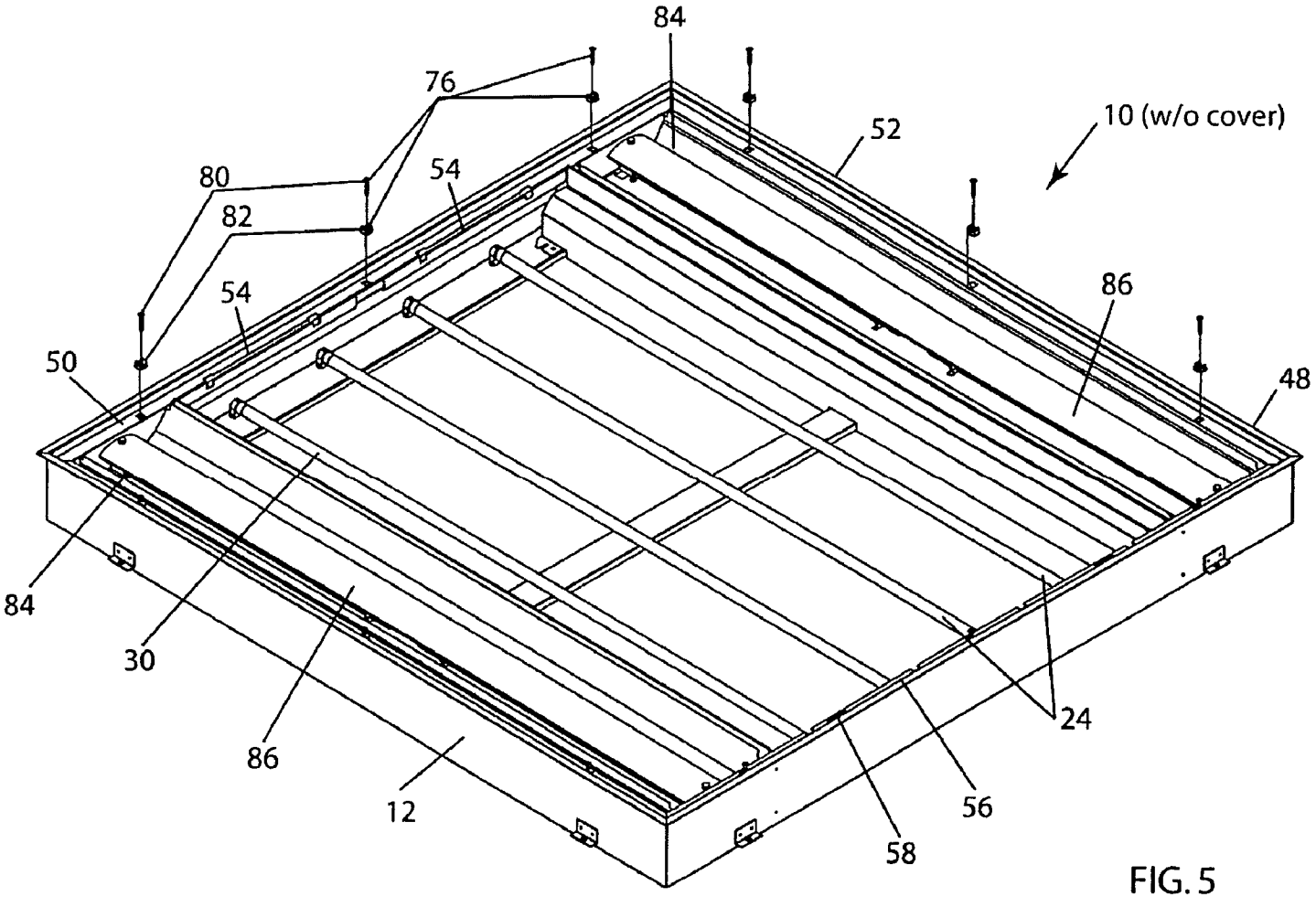
FIG. 5 is a perspective view of the lighting fixture of FIG. 1 with the cover removed.
Figure 6:
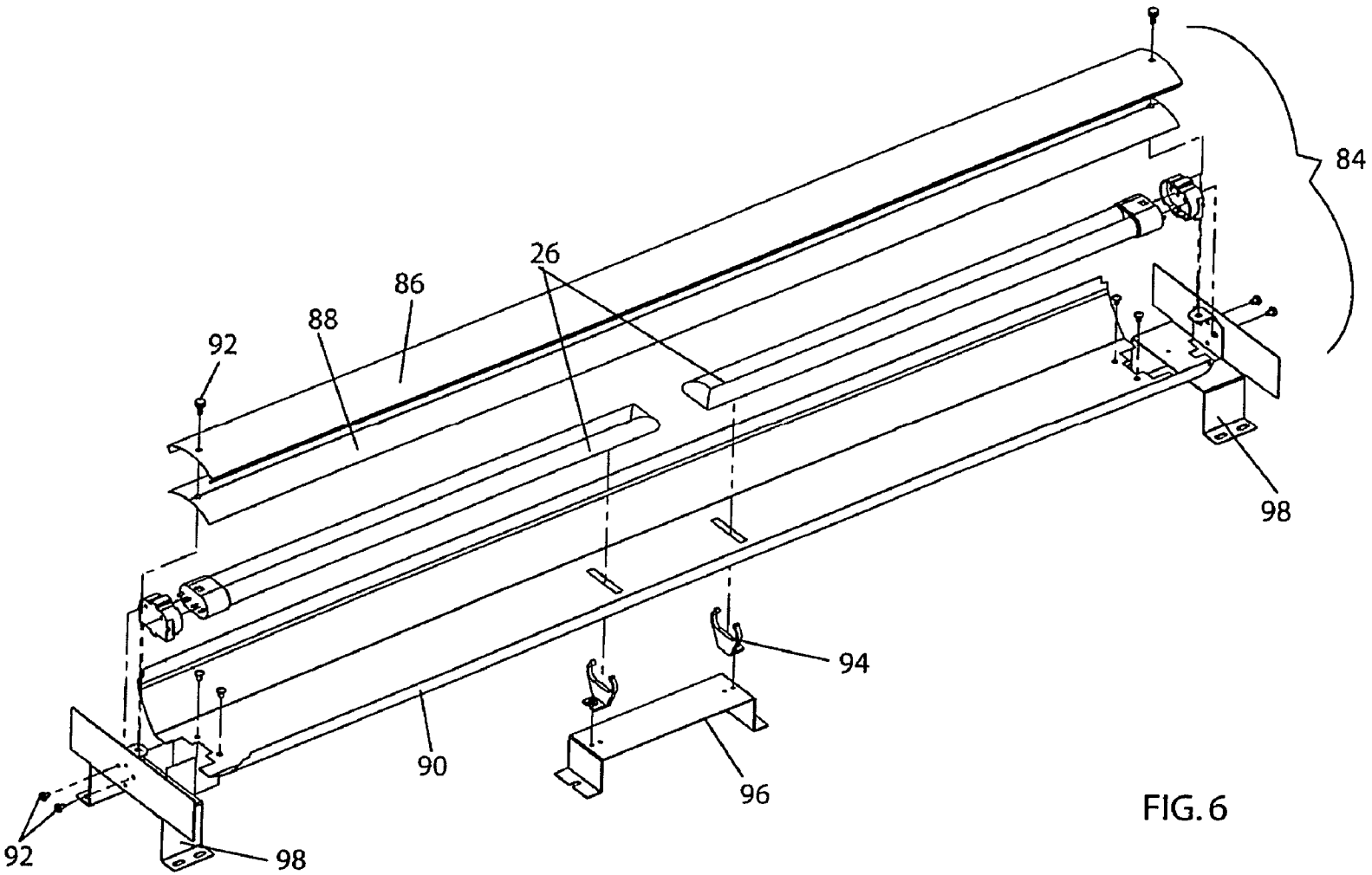
FIG. 6 an exploded view of the exam-lamping assembly including the exam-light source of the lighting fixture of FIG. 1.

Lighting fixture 10 includes at least one exam-light source 26 within each of two side regions 16 and a fixture controller 28 which is able to separately control graphics-light source 24 and exam-light source 26 as illustrated in FIGS. 1-3. This allows for the graphics image to be displayed for a viewer along middle region 14 and also allows illumination for examination which is provided from side regions 16. Exam-light source 26 is part of an exam-lamping assembly 84 as seen in FIGS. 5-6. As illustrated in FIG. 6, exam-lamping assembly 84 includes various screws 92 which keep exam-lamping assembly 84 in the assembled position. As seen in FIG. 6, exam-lamping assembly 84 further includes lamp support clips 94 and bracket 96 which hold aluminum diffuser 86, acrylic diffuser 88, parabolic diffuser 90 and lamps 26 in the assembled position. Lamps 26 are further held in place by two lamp socket brackets 98 which are placed on each side of lamps 26 as seen in FIG. 6. Lighting fixture 10 includes exam-light ballast 108 and graphics-light ballast 110 (including a ballast cover 114) as illustrated in FIG. 7.

Figure 4:
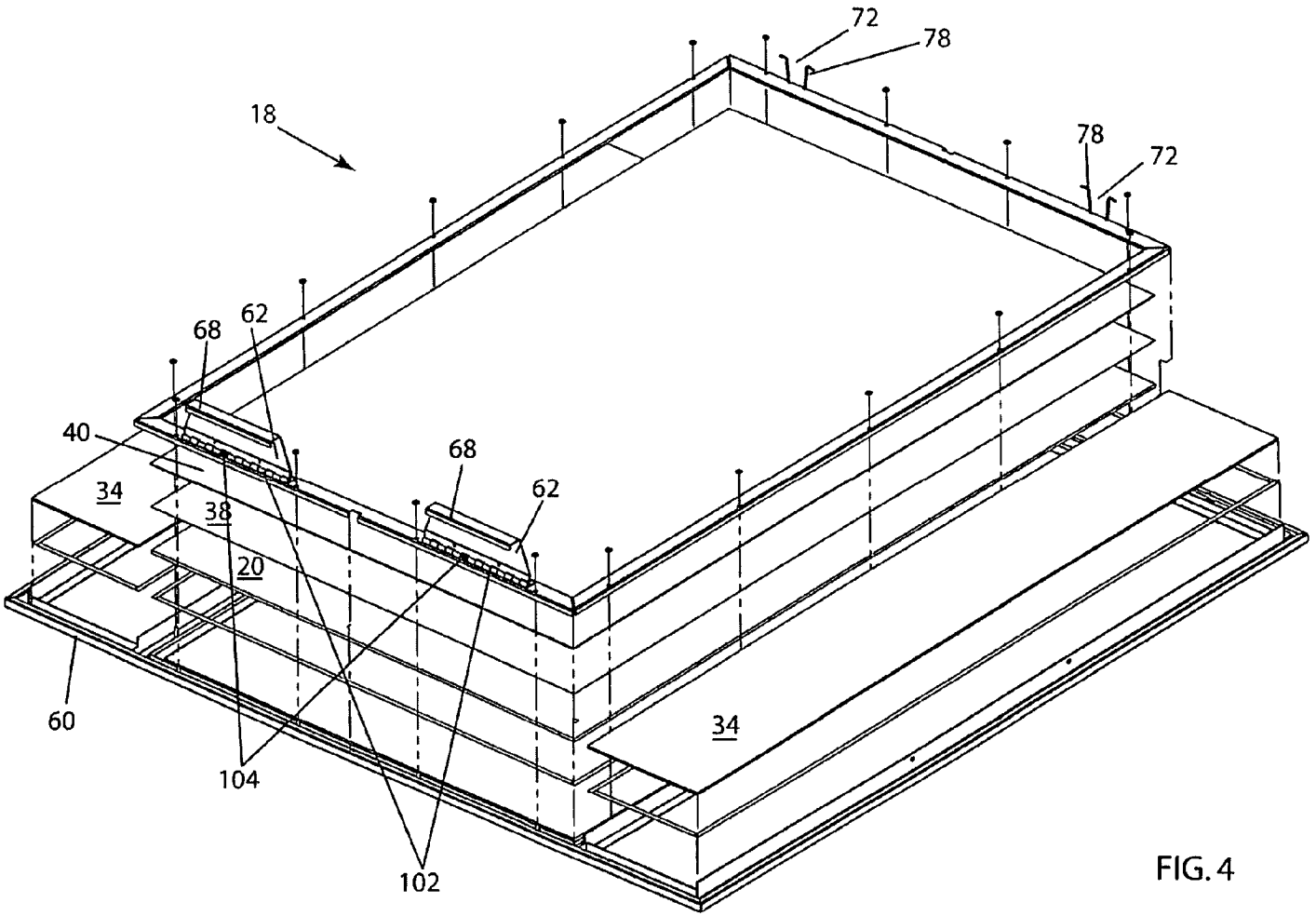
FIG. 4 is an exploded perspective view of the cover of the lighting fixture of FIG. 1.

As illustrated in FIGS. 1-2 and 4, cover 18 is a single structure over middle region 14 and both side regions 16. FIGS. 1-2 illustrate cover 18 in an open position to allow access to lamps 30. FIG. 7 illustrates that lens 20 is sealingly engaged with cover 18 and cover 18 is sealingly engaged with body 12.

Figure 7:
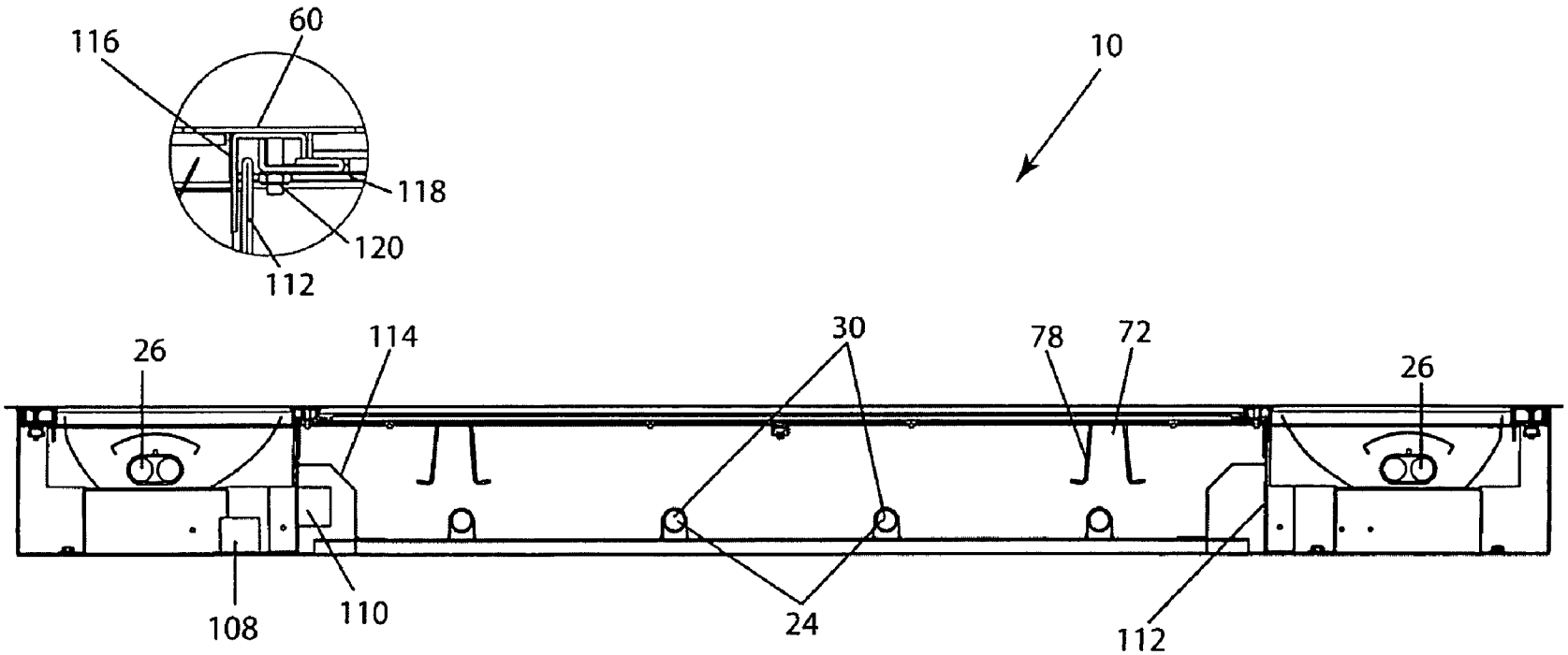
FIG. 7 is a side perspective view of the lighting fixture of FIG. 1 illustrating the light blocking bracket.

FIG. 7 also illustrates lens 20 includes middle lens 32 and further includes two side lenses 34 each over a respective one of side regions 16 and that each of side lenses 34 is sealingly engaged with cover 18. Middle region 14 and side regions 16 are separated by divider 112 as illustrated in FIG. 7. Lighting fixture 10 is given stability through the interaction of light blocking bracket 116 with middle lens retainer bracket 118 as seen in the exploded view of FIG. 7. The exploded view of FIG. 7 also illustrates retainer bracket fasteners 120 which secure middle lens retainer bracket 118 to light blocking bracket 116 and ultimately to frame 60.

FIG. 4 is an exploded view of lighting fixture 10 which illustrates that lens 20 has inside surface 36 and the graphics image is on a separate light-transmissive graphics layer 38 removably placed on inside surface 36. Light fixture 10 further includes a separate inner layer 40 as illustrated in FIG. 4. Graphics layer 38 is sandwiched between lens 20 and inner layer 40. Inner layer 40 as illustrated in FIG. 4 is a light-diffusing layer.

Figure 8:
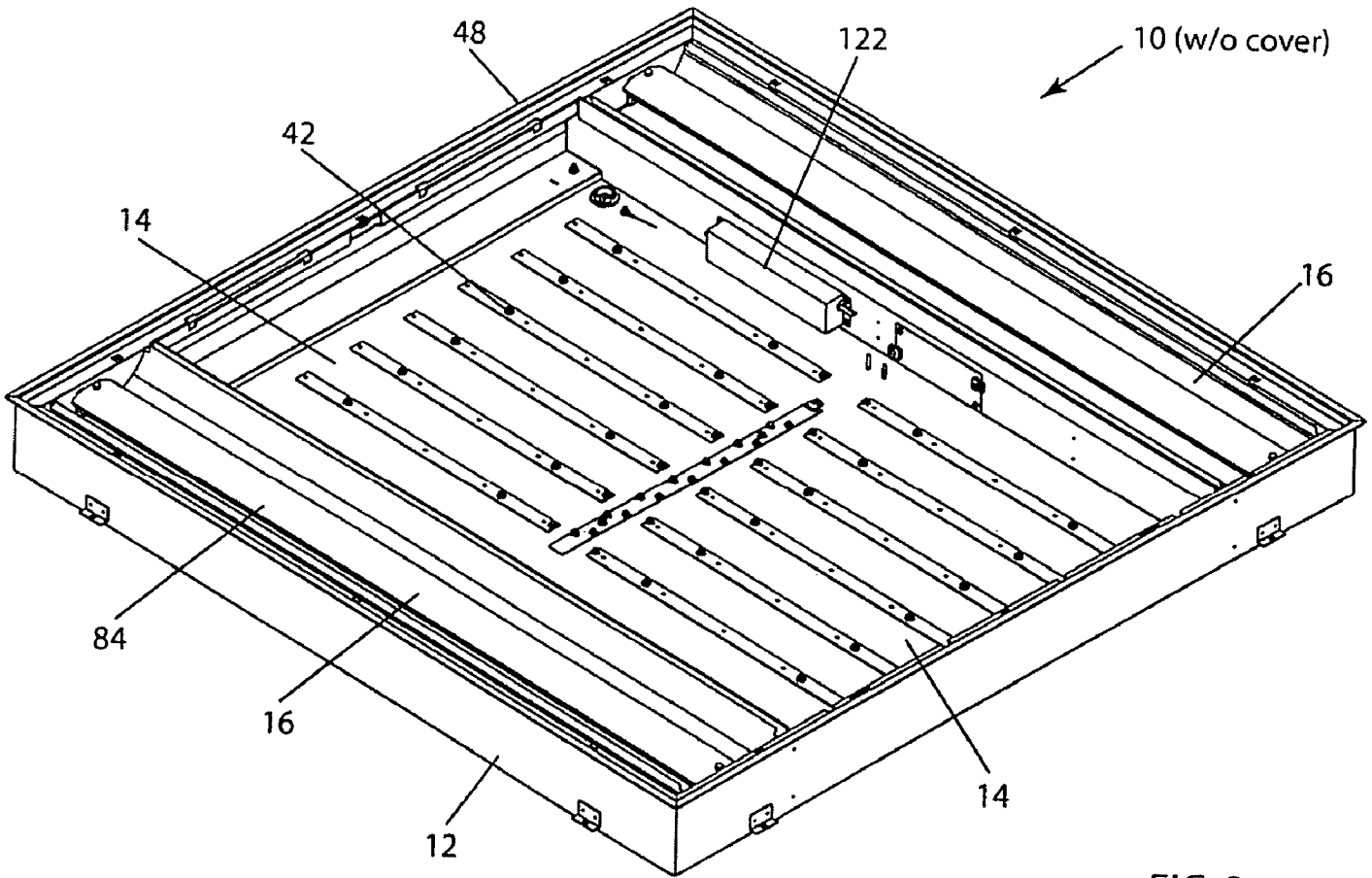
FIG. 8 is a perspective view of an alternate embodiment of the lighting fixture (with the cover removed) of FIG. 1, in which the graphics light source is an array of white LEDs.

As shown in FIGS. 1-3, graphics-light source 24 is a plurality of fluorescent lamps 30. In an alternate embodiment, as shown in FIG. 8, graphics-light source 24 is an array of white light emitting diodes (LEDs) 42. FIG. 8 illustrates LED driver 122 with constant voltage output and line-voltage input.

Figure 9:
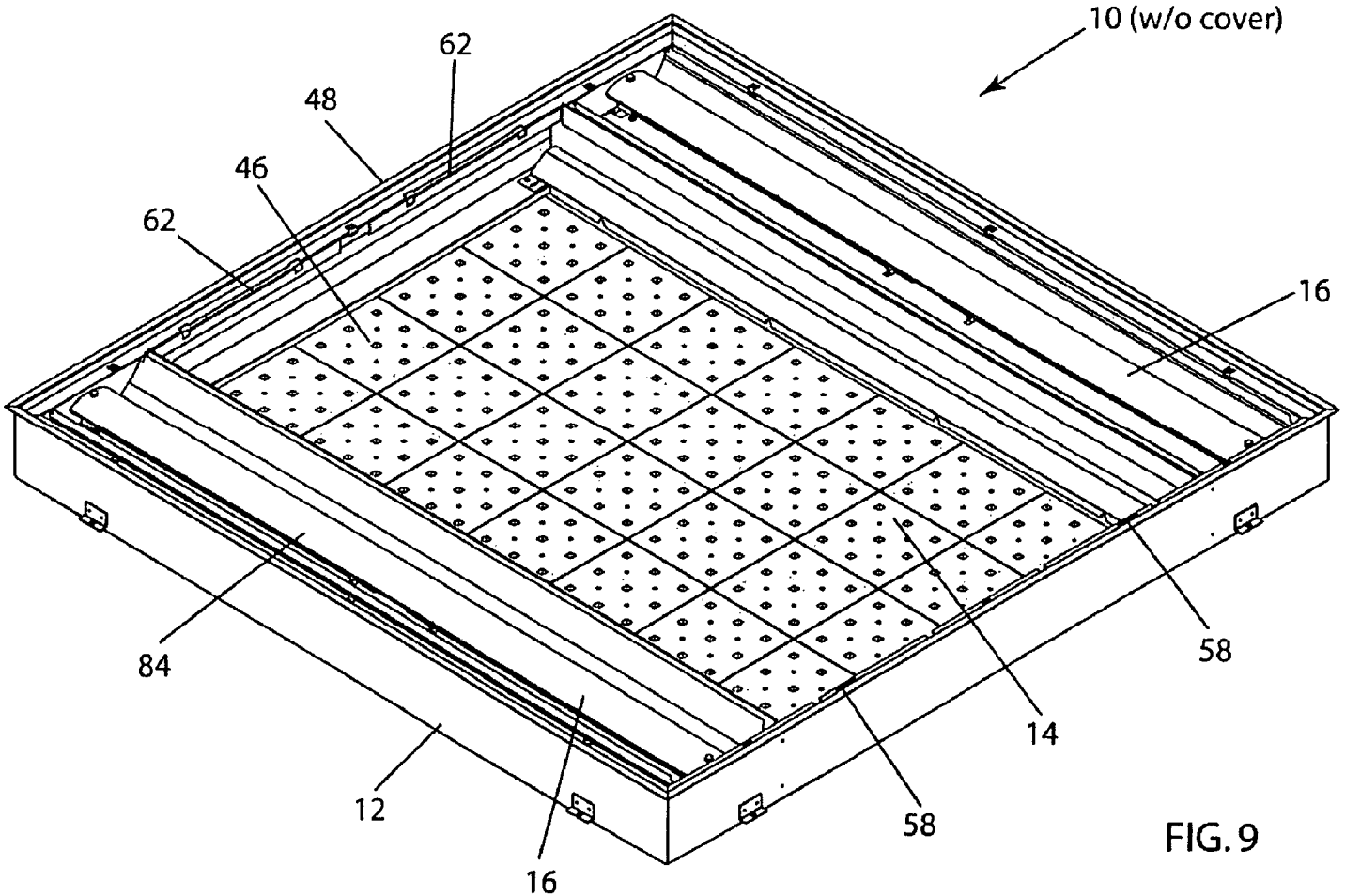
FIG. 9 is a perspective view of an alternate embodiment of the lighting fixture (with the cover removed) of FIG. 1, in which the graphics light source is an array of colored LEDs.
Figure 11:
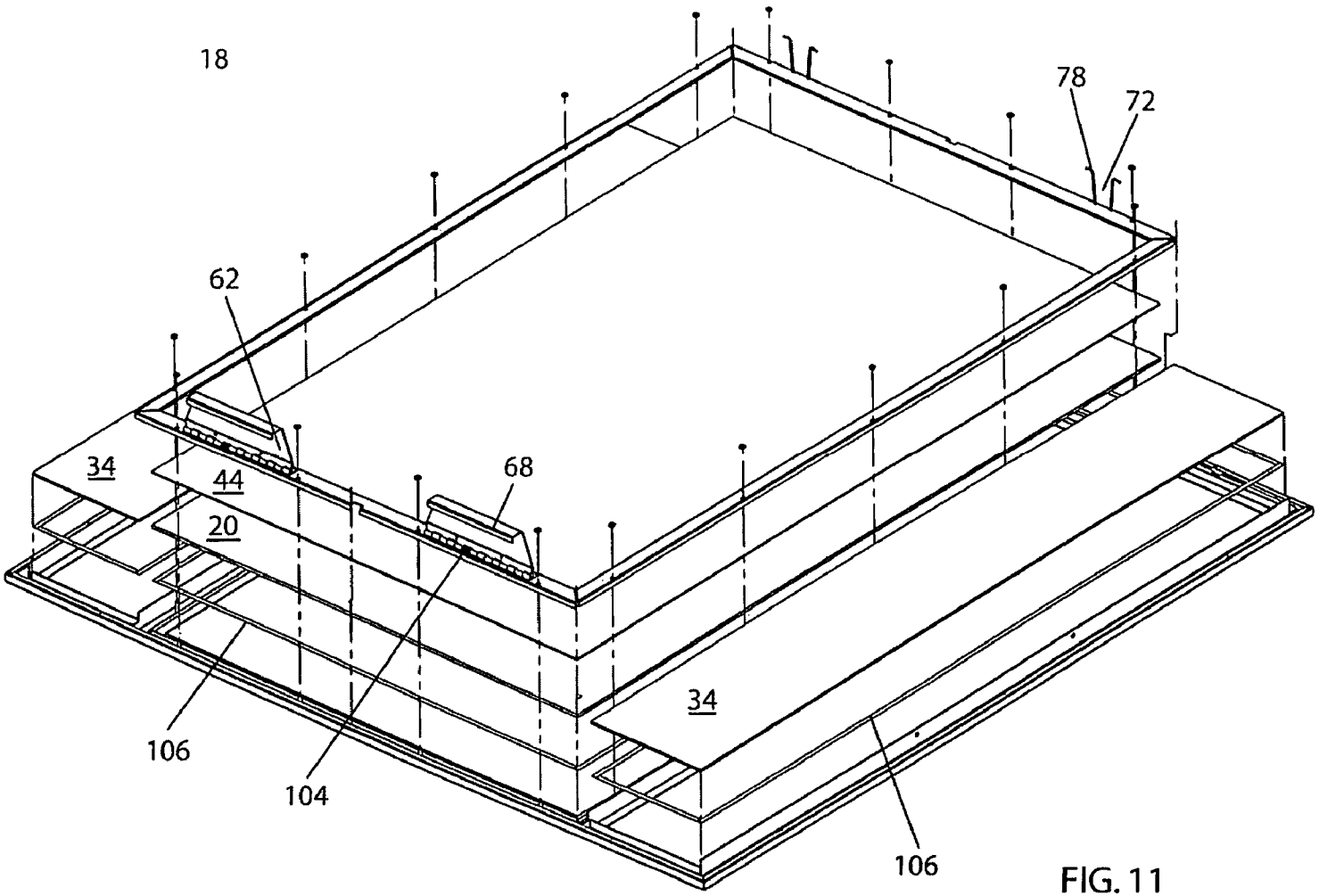
FIG. 11 is an exploded perspective view of the cover of the lighting fixture of FIG. 9.

Another alternate embodiment, as shown in FIGS. 9 and 11, includes a semi-transparent screen layer 44 wherein graphics-light source 24 is an array of color-controllable LEDs 46, and the graphics image is formed by LED illumination of screen layer 44. In another embodiment, lens 20 and screen layer 44 are a single layer (not shown). Screen layer 44 and lens 20 may also be separate layers as illustrated in FIG. 11.

Figure 10B:
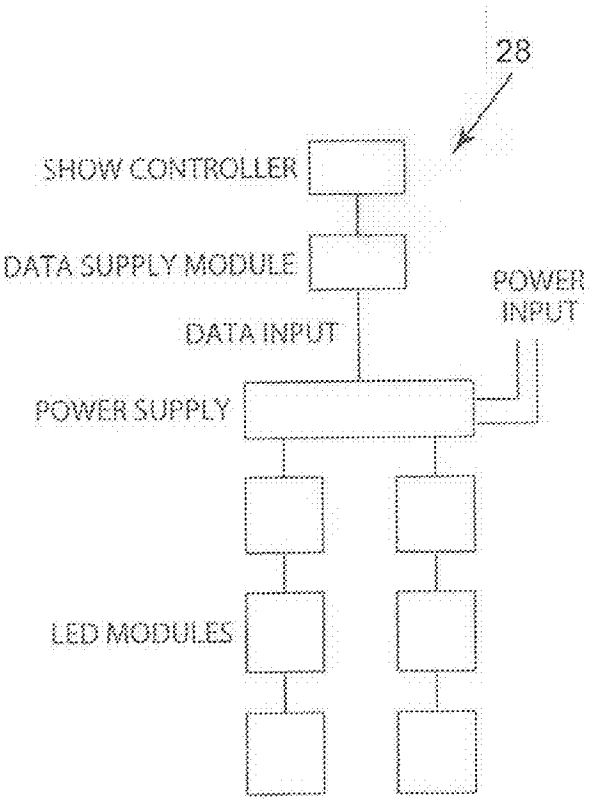
FIG. 10B is an system schematic of the lighting fixture of FIG. 9.
Figure 10A:
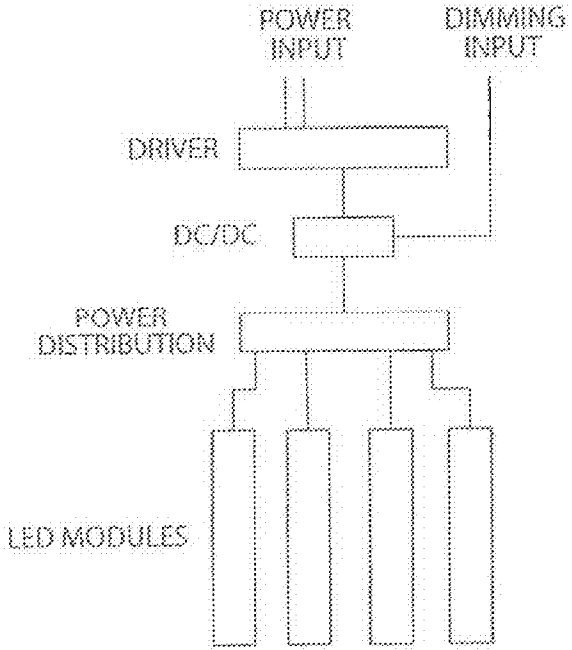
FIG. 10A is an system schematic of the lighting fixture of FIG. 8.

The light fixture 10 preferably includes a fixture controller 28 which is programmed to temporally control the LEDs of the array as seen in FIGS. 8-9. Fixture controller 28 can be one switch or a series of switches. The programmed fixture controller can be programmed to provide a variety of possible time histories of illumination by varying source selection, color, and time histories of the LEDs. FIG. 10A is an LED system schematic of the lighting fixture of FIG. 8. FIG. 10B is an LED system schematic of the lighting fixture of FIG. 9.

As illustrated in FIGS. 1-3 and 5, body 12 of lighting fixture 10 has a rectangular cover-engaging perimeter 48 and includes first flange 50 along one perimeter edge 52 which has at least one hook-receiving opening 54 therein (hook-receiving opening is specifically shown on FIG. 5). Body 12 also includes second flange 56 along the opposite perimeter edge having at least one suspension-member-receiving opening 58 as seen in FIGS. 1-3 and 5.

FIGS. 1-3 illustrate cover 18 which includes rectangular frame 60 which has at least one catch arm 62 with proximal end 64 rotatably mounted to one edge of frame 60 and distal end 66 having catch-arm hook 68. As seen in FIG. 3, each hook 68 is removably insertable in one of the hook-receiving opening(s) 54. Cover 18 also includes cover hinge 102 and torsion spring 104 which assist in moving cover 18 from open to closed position. FIG. 3 also includes an enhanced view of catch arm 62 and more clearly illustrates several elements of fixture 10.

As illustrated in FIG. 2, at least one suspension member 72 is mounted to an edge opposite catch arm 62 on frame 60. Each suspension member 72 is insertable in one of the suspension-member-receiving opening(s) 58 as seen in FIG. 2. Catch arm(s) 62 and suspension member(s) 72 each have sufficient length to suspend cover 18 away from body 12 along its entire cover-engaging perimeter 48 when they are hangingly engaged with flanges 50, 56, and frame fasteners 76, along frame engaging perimeter 60, are in a fixture-closed position as seen in FIGS. 2 and 7. FIG. 2 also includes an enhanced view of suspension-member receiving opening 58 which is situated on gasket seal surface 100. FIG. 2 more clearly illustrates several elements of fixture 10. As illustrated in FIG. 5, frame fasteners 76 include lens screw 80 and cage nut 82.

FIG. 7 illustrates lighting fixture 10 in a closed position. Each of the suspension member(s) 72 are preferably spring clip(s) 78. Preferred embodiments as seen in FIG. 3 include a pair of catch arms 62 spaced along one edge of frame 60 and a pair of spring clips 78 spaced along opposite edge of frame 60.

One-person servicing is facilitated by cover 18 being supported along one perimeter edge 52 in a fully-open position (as seen in FIGS. 1-3), supported along two opposite edges in a suspended position, and fully engaged with the body in the fixture-closed position (as seen in FIG. 7).

When lighting fixture 10 is in use, the graphics image is projected from lighting fixture 10 and can be periodically changed to a new graphics image. To change the graphics image, one must first install a plurality of ceiling light fixtures 10 in patient rooms (or any room where light fixture 10 is desired). Cover 18 must then be opened, graphics layer 38 is removed from each of the opened fixtures 10, removed graphics layer 38 is replaced with a different graphics layer 38, and cover 18 is closed. The step of removing graphics layer 38 includes removing each of the graphics layers 38 from its corresponding cover 18. The step of removing graphics layers 38 also includes fully detaching each of the opened covers 18 from its corresponding fixture body 12.

Body 12 may be constructed out of 0.050-0.063 inch-thick, formed sheet aluminum and associated hardware and electrical components. Body 12 is preferably TIG-welded to ensure a sealed fixture 10. Internal brackets can be spot welded or fastened to body 12 by pressure-fit, sealed studs.

Cover 18 consists of a formed sheet of aluminum frame that is TIG-welded at its corner seams. Cover 18 also contains stiffening members spot-welded onto frame 60 to prevent excessive flexibility. Side lenses 34 are preferably made from clear acrylic sheet with a thickness of 0.125 inches. Middle lens 32 is preferably made from clear acrylic sheet with a thickness of 0.177 inches. Lenses 32 and 34 are preferably sealed and secured to cover 18 by adhesive tape 106 as illustrated in FIG. 4. Double-sided 3M VHB adhesive tape is preferably used.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. A ceiling light fixture for medical patient rooms, comprising:

a body defining a middle region and two side regions on along opposite sides of the middle region;

a cover movably attached to the body and including a lens over at least the middle region;

a graphics image associated with the middle region and substantially parallel to the lens;

at least one graphics-light source within the middle region configured for illuminated display of the graphics image;

at least one exam lamp within each of the two side regions, the two side regions further including an element below the lamp to redirect light therefrom and a reflector above the lamp to direct light downwardly onto the patient bed below, the two side regions cooperating to illuminate the patient bed for examination purposes when needed;

a fixture controller to separately control the light sources, whereby the graphics image is displayed for the patient along the middle region and illumination for medical examination is provided from the side regions.

2. The medical-patient-room ceiling light fixture of claim 1 wherein the cover is a single structure over the middle region and both of the side regions.

3. The medical-patient-room ceiling light fixture of claim 2 wherein the lens is sealingly engaged with the cover and the cover is sealingly engaged with the body.

4. The medical-patient-room ceiling light fixture of claim 3 wherein the lens is a middle lens and the fixture further includes two side lenses each over a respective one of the side regions.

5. The medical-patient-room ceiling light fixture of claim 4 wherein each of the side lenses is sealingly engaged with the cover.

6. The medical-patient-room ceiling light fixture of claim 1 wherein the lens has an inside surface and the graphics image is on a separate light-transmissive graphics layer removably placed on the inside surface.

7. The medical-patient-room ceiling light fixture of claim 6 further including a separate inner layer, the graphics layer being sandwiched between the lens and the inner layer.

8. The medical-patient-room ceiling light fixture of claim 6 wherein the inner layer is a light-diffusing layer.

9. The medical-patient-room ceiling light fixture of claim 1 wherein the at least one graphics-light source is a plurality of fluorescent lamps.

10. The medical-patient-room ceiling light fixture of claim 1 wherein the at least one graphics-light source is an array of white LEDs.

11. The medical-patient-room ceiling light fixture of claim 1 including a semi-transparent screen layer and wherein the at least one graphics-light source is an array of color-controllable LEDs and the graphics image is formed by LED illumination of the screen layer.

12. The medical-patient-room ceiling light fixture of claim 11 wherein the lens and the screen layer are a single layer.

13. The medical-patient-room ceiling light fixture of claim 11 wherein the fixture controller is programmed to temporally control the LEDs of the array.

14. The medical-patient-room ceiling light fixture of claim 13 wherein the programmed fixture controller is programmed to be controllable.

15. The medical-patient-room ceiling light fixture of claim 1 wherein:

the body has a rectangular cover-engaging perimeter and includes along one perimeter edge a first flange having at least one hook-receiving opening therein and along the opposite perimeter edge a second flange having at least one suspension-member-receiving opening;

the cover includes a rectangular frame, at least one catch arm with a proximal end rotatably engaged to a first edge of the frame and a distal end having a catch-arm hook, each hook removably insertable in a corresponding one of the hook-receiving openings, and at least one suspension member mounted to an opposite edge of the frame, each said suspension member insertable in a corresponding one of the suspension-member-receiving openings, the catch arms and suspension members each having sufficient length to suspend the cover away from the body along its entire cover-engaging perimeter when they are hangingly engaged with the flanges; and frame fasteners along the frame for engaging the perimeter in a fixture-closed position, whereby one-person servicing is facilitated by the cover being supported along one perimeter edge in a fully-open position, supported along two opposite edges in a suspended position, and fully engaged with the body in the fixture-closed position.

16. The medical-patient-room ceiling light fixture of claim 15 wherein each of the suspension members is a spring clip.

17. The medical-patient-room ceiling light fixture of claim 16 wherein there are a pair of catch arms spaced along the one edge of the frame and a pair of spring clips spaced along the opposite edge of the frame.

18. The medical-patient-room ceiling light fixture of claim 17 wherein the suspension members are spring clips.

19. A method for facilitating changing of graphic images on the ceilings of a plurality of patient rooms in a medical facility, comprising the steps of:

installing a plurality of ceiling light fixtures in the patient rooms, each fixture including:

a body defining a middle region and two side regions on along opposite sides of the middle region;

a cover movably attached to the body and including a lens over at least the middle region;

a graphics image associated with the middle region and substantially parallel to the lens;

at least one graphics-light source within the middle region configured for illuminated display of the graphics image;

at least one exam lamp within each of the two side regions, the two side regions further including an element below the lamp to redirect light therefrom and a reflector above the lamp to direct light downwardly onto the patient bed below, the two side regions cooperating to illuminate the patient bed for examination purposes when needed; and a fixture controller to separately control the light sources, whereby the graphics image is displayed for the patient along the middle region and illumination for medical examination is provided from the side regions;

opening the covers of a plurality of the fixtures;

removing the graphics images from each of the opened fixtures;

replacing the removed graphics images with other graphics images; and closing the covers.

20. The method of claim 19 wherein the removed graphics image is replaced with a different graphics image selected from a plurality of graphics images.

21. The method of claim 19 wherein the step of removing the graphics images includes removing each of the graphics images from its corresponding cover.

22. The method of claim 19 wherein the step of removing the graphics images includes fully detaching each of the opened covers from its corresponding fixture body.

23. The method of claim 19 wherein:

the body defines a rectangular cover-engaging perimeter and includes a first flange along one perimeter edge having at least one hook-receiving opening therein and a second flange along the opposite perimeter edge having at least one suspension-member-receiving opening;

the cover includes a rectangular frame, at least one catch arm with a proximal end rotatably mounted to one edge of the frame and a distal end having a catch-arm hook, each hook removably insertable in one of the hook-receiving openings, and at least one suspension member mounted to an opposite edge of the frame, each said suspension member insertable in one of the suspension member-receiving openings, the catch arms and suspension members each having sufficient length to suspend the cover away from the body along its entire cover-engaging perimeter when they are hangingly engaged with the flanges;

frame fasteners along the frame engaging the perimeter in a fixture-closed position, whereby one-person opening, removing, replacing and closing is facilitated by the cover being supported along one perimeter edge in a fully-open position, supported along two opposite edges in a suspended position, and fully engaged with the body in the fixture-closed position.

24. The method of claim 23 wherein the step of removing the graphics images includes removing each of the graphics images from its corresponding cover.

25. The method of claim 23 wherein the step of removing the graphics images includes fully detaching each of the opened covers from its corresponding fixture body.

* * * * *